US006343582B1

(12) United States Patent
Peng

(10) Patent No.: US 6,343,582 B1
(45) Date of Patent: Feb. 5, 2002

(54) DECOMPRESSION DEVICE FOR FOUR-STROKE ENGINE

(75) Inventor: Yu-Yin Peng, Hsin-Chu (TW)

(73) Assignee: Industrial Technology Research Institute (TW)

( * ) Notice: Subject to any disclaimer, the term of this patent is extended or adjusted under 35 U.S.C. 154(b) by 0 days.

(21) Appl. No.: 09/246,095

(22) Filed: Feb. 8, 1999

(51) Int. Cl.[7] ..... F01L 1/04; F01L 13/08
(52) U.S. Cl. ..... 123/182.1
(58) Field of Search ..... 123/182.1, 90.17

(56) References Cited

U.S. PATENT DOCUMENTS

| | | | | | |
|---|---|---|---|---|---|
| 3,395,689 | A | * | 8/1968 | Kruse | 123/182.1 |
| 4,455,977 | A | * | 6/1984 | Kuczenski | 123/198 DC |
| 4,672,930 | A | * | 6/1987 | Sumi | 123/182.1 |
| 4,790,271 | A | * | 12/1988 | Onda | 123/182.1 |
| 5,816,208 | A | * | 10/1998 | Kimura | 123/182.1 |
| 5,884,592 | A | * | 3/1999 | Korostenski et al. | 123/90.17 |
| 5,957,097 | A | * | 9/1999 | Schanz | 123/90.17 |

* cited by examiner

*Primary Examiner*—Henry C. Yuen
*Assistant Examiner*—Arnold Castro

(57) ABSTRACT

A decompression device for a four-stroke engine, which drives the inlet valve and the exhaust valve by using the profile surface of a cam and rocker mechanism. This cam includes a guiding recess provided on the side surface thereof and a slot provided on the cam profile surface communicating with the guiding recess. The decompression device further includes a centrifugal member, received within the guiding recess, having a projecting portion and being rotatable and movable within the guiding recess, and a spring having two ends fixed to the cam and the centrifugal member. By the cooperation with the spring and the guiding recess, when the cam is rotated at a lower speed, the projecting portion of the centrifugal member projects through the slot to the outside of the cam profile surface under the action of a weaker centrifugal force, thereby lifting the second follower so as to open the exhaust valve before the TDC of the compression stroke, and when the cam is rotated at a higher speed, the projecting portion of the centrifugal member sinks into the inside of the cam profile surface under the action of a stronger centrifugal force, thereby closing the exhaust valve.

2 Claims, 5 Drawing Sheets

DECOMPRESSION DEVICE FOR FOUR-STROKE ENGINE

FIELD OF THE INVENTION

The present invention relates to a decompression device for a four-stroke engine, and more particularly, to a decompression device which temporarily opens the exhaust valve before the piston reaches the top dead center (TDC) in the compression stroke, when starting a hand-held four-stoke engine.

DESCRIPTION OF THE RELATED ART

The engines are frequently used in mowers, chain-sawing machines, pumps and exhaust fans etc. As a two-stroke engine is apt to cause air pollution, it is gradually substituted by a four-stroke engine which serves as the power source of the afore-mentioned machines.

An inlet valve and an exhaust valve are used to control the intaking and exhausting of the engine, respectively. The inlet valve and the exhaust valve are opened and closed by using a cam-follower mechanism, thereby realizing an inlet stroke, a compression stroke, a power stroke (or combustion stroke) and an exhaust stroke.

FIG. 1 is a front view illustrating a cam-follower mechanism of a conventional four-stroke engine. An arrow indicates the rotating direction of the cam. FIG. 2A is a front view illustrating the cam-gear portion shown in FIG. 1. FIG. 2B is a side view illustrating the cam-gear portion shown in FIG. 1.

As shown in FIG. 1, the cam-follower mechanism comprises a cam 101 having a profile surface and a central hole 107, a gear 102 having the same central hole 107 as that of cam 101 and is fixed to cam 101, a first follower 103 and a second follower 105 being biased, respectively, by a spring (not shown) so as to keep in contact with cam 101 and swingable around a pin 108, and a first link 104 and a second link 106 keeping in contact with first follower 103 and second follower 105 at a point M and a point N, respectively.

Hereinbelow, the operation of the cam-follower mechanism will be described.

Referring to FIG. 1, gear 102 is driven to drive cam 101 to rotate clockwise. First follower 103 and cam 101 are constantly kept in touch with each other as described above. When first follower 103 is in contact with the ascending profile of cam 101, first follower 103 is lifted by cam 101 and a counterclockwise pivoting moment around pin 108 is generated. Thus, the point M rises and pushes up first link 104 and, in turn, further opens an inlet valve (not shown) through another mechanism (not shown).

Next, when first follower 103 is in contact with the descending profile of cam 101, the inlet valve is closed by the restoring force of an inlet valve spring (not shown).

Likewise, when second follower 105 is kept in contact with the ascending profile of cam 101, second follower 105 is lifted by cam 101 and a clockwise pivoting moment around pin 108 is generated. Thus, the point N rises and pushes up second link 106 and, in turn, further open an exhaust valve (not shown) through still another mechanism (not shown).

Next, when second follower 105 is in contact with the descending profile of cam 101, the exhaust valve is closed by the restoring force of an exhaust valve spring (not shown).

It should be understood that first follower 103 and second follower 105 are located on different two planes parallel to the paper plane of FIG. 1.

FIG. 3 is a chart showing the relationship between the opening Ψ of the inlet (exhaust) valve and the crank angle θ in a conventional four-stroke engine. As shown in FIG. 3, the horizontal and vertical axis denote the crank angle θ and the opening Ψ of the valves respectively, the symbols E, I, C and P denote the exhaust stroke, the inlet stroke, the compression stroke and the power stroke respectively, and the symbols TDC and BDC denote the top dead center and the bottom dead center of the engine piston respectively.

Referring to FIG. 3, the curve shown by dotted lines designate the relationship between the opening Ψ of an inlet valve IV and the crank angle θ, while the curve shown by solid lines designate the relationship between the opening Ψ of an exhaust valve EV and the crank angle θ. When the crank angle θ is from 0 to 360°, the piston moves from a bottom dead center (BDC) to a top dead center (TDC), and then return to the BDC.

Exhaust stoke E is realized when the crank angle θ is approximately between 0° and 180°. In this duration, exhaust valve EV is gradually opened to a maximum opening and then gradually closed. On the other hand, inlet stroke I is realized when the crank angle θ is approximately between 180° and 360°. In this duration, inlet valve IV is gradually opened to a maximum opening and then gradually closed. Thereafter, a compression stroke C is realized when the crank angle θ is approximately between 360° and 540°, and a power stroke P is realized when the crank angle θ is approximately between 540° to 720°. Among these four strokes, the pressure in the cylinder is the maximum when the piston reaches the TDC in the compression stroke C. Therefore, the resistance force of the engine shaft is the maximum.

When starting a conventional four-stroke engine, an external force (such as electric force or human force) is required to rotate the engine shaft so as to provide a moment of inertia for the engine to begin self-running after ignition in the combustion chamber. Due to the maximum resistance force when the piston reaches the TDC in the compression stroke, a larger force is required to overcome it so as to start the engine.

As a result, if the exhaust valve is opened slightly and temporarily before the piston reaching the TDC in the compression stroke, it is helpful for decreasing the pressure in the cylinder and reducing the starting force. However, this function has to be disabled when the engine is operated normally so that the efficiency is not affected. It is therefore a problem to be solved by the present invention.

SUMMARY OF THE INVENTION

In order to solve the above problem, it is therefore an object for the present invention to provide a decompression device for a four-stroke engine which can decompress the pressure in the cylinder by opening the exhaust valve before the TDC in the compression stroke, thereby reducing the starting force. Alternatively, this device can also disable the decompression function when the engine is operated normally.

In accordance with the present invention, there is provided a decompression device for a four-stroke engine, wherein the operating cycle of the engine includes an inlet stroke, a compression stroke, a power stroke and an exhaust stroke, and the engine includes a piston which reaches a top dead center (TDC) and a bottom dead center (BDC) at the two ends of each stroke, the decompression device comprising: an inlet valve and an exhaust valve for controlling the inlet stroke and the exhaust stroke respectively, a first rocker and a second rocker for driving the inlet valve and the exhaust valve respectively, a first link and a second link for driving the first and the second rocker respectively, a first follower and a second follower for driving the first link and the second link respectively, and a cam having a cam profile surface for driving the first and the second followers, characterized in: that the cam further comprises a guiding recess provided on the side surface thereof and a slot provided on the cam profile surface communicating with the guiding recess; that the decompression device further comprises a centrifugal member, received within the guiding recess, having a projecting portion and being rotatable and movable within the guiding recess, and a spring having two ends fixed to the cam and the centrifugal member; and that through the cooperation with the spring and the guiding recess, when the cam is rotated at a lower speed, the projecting portion of the centrifugal member projects through the slot to the outside of the cam profile surface under the action of a weaker centrifugal force, thereby lifting the second follower so as to open the exhaust valve before the TDC of the compression stroke, and when the cam is rotated at a higher speed, the projecting portion of the centrifugal member sinks into the inside of the cam profile surface under the action of a stronger centrifugal force, thereby closing the exhaust valve.

In the afore-described decompression device, preferably the centrifugal member further comprises an elliptic through hole, and the cam further comprises at least one pin located in the guiding recess and penetrating through the elliptic through hole, thereby guiding the movement and rotation of the centrifugal member.

DETAILED DESCRIPTION OF THE PREFERRED EMBODIMENT

Figure 1:
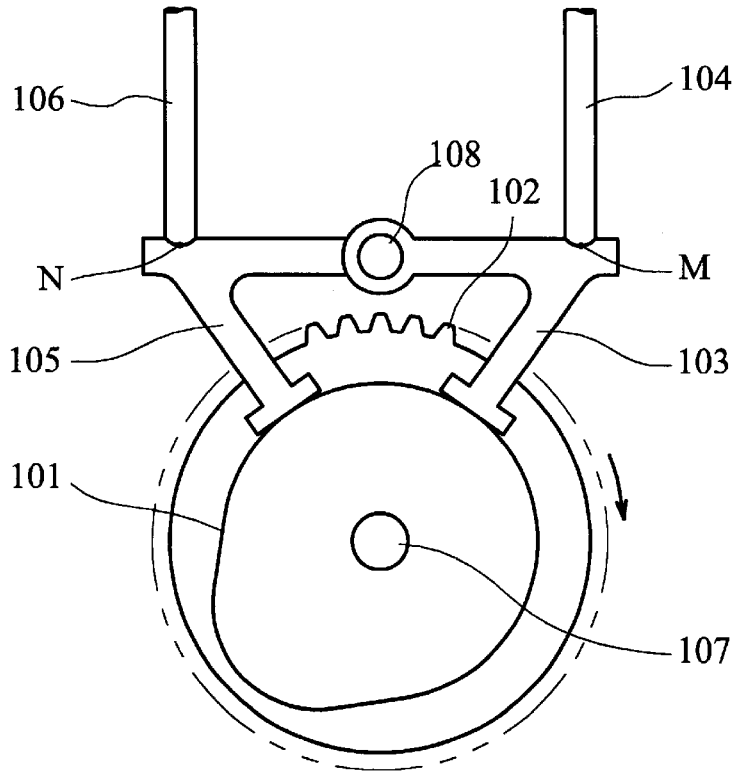
Fig. 1 (Prior Art)
FIG. 1 is a front view showing a cam-follower mechanism of a conventional four-stroke engine.
Figure 2A:
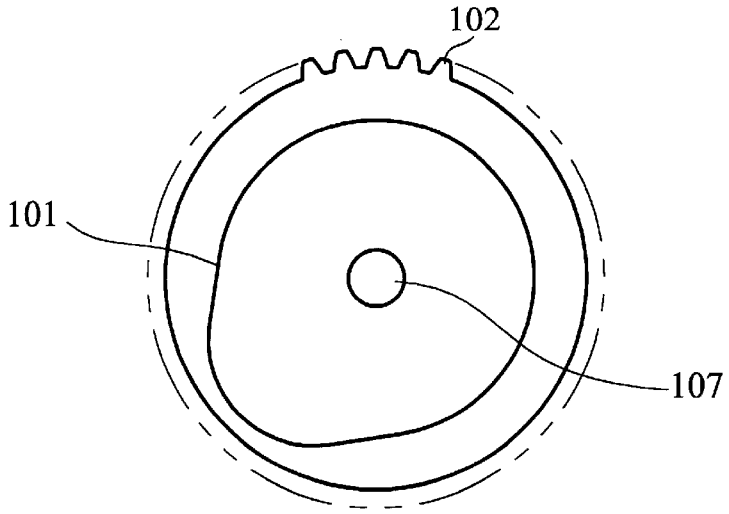
Fig. 2A (Prior Art)
FIG. 2A is a front view showing a cam-gear structure as shown in FIG. 1.
Figure 2B:
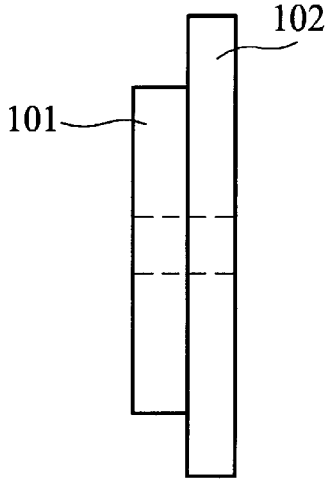
Fig. 2B (Prior Art)
FIG. 2B is a side view of FIG. 2A.
Figure 3:
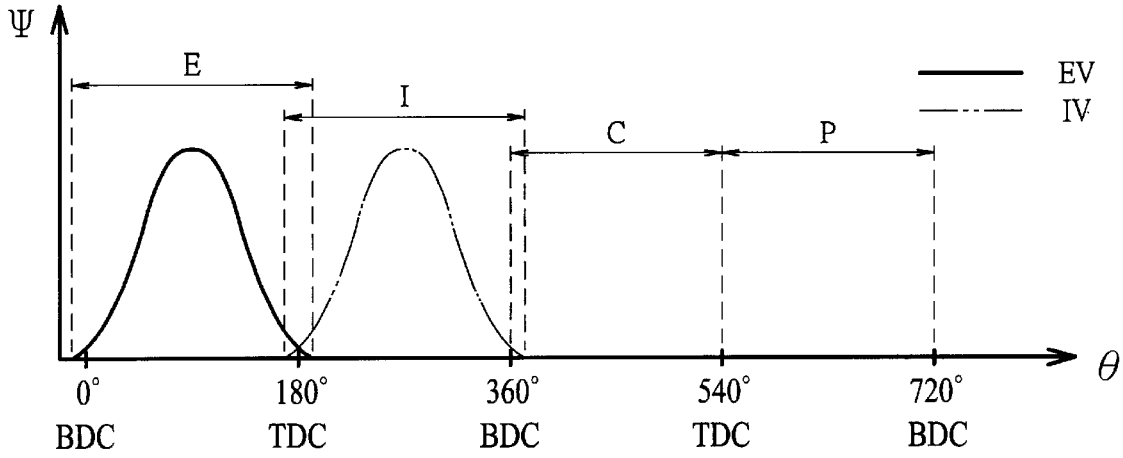
Fig. 3 (Prior Art)
FIG. 3 is a chart showing the relationship between the opening Ψ of the inlet (exhaust) valve and the crank angle θ in a conventional four-stroke engine.
Figure 4:
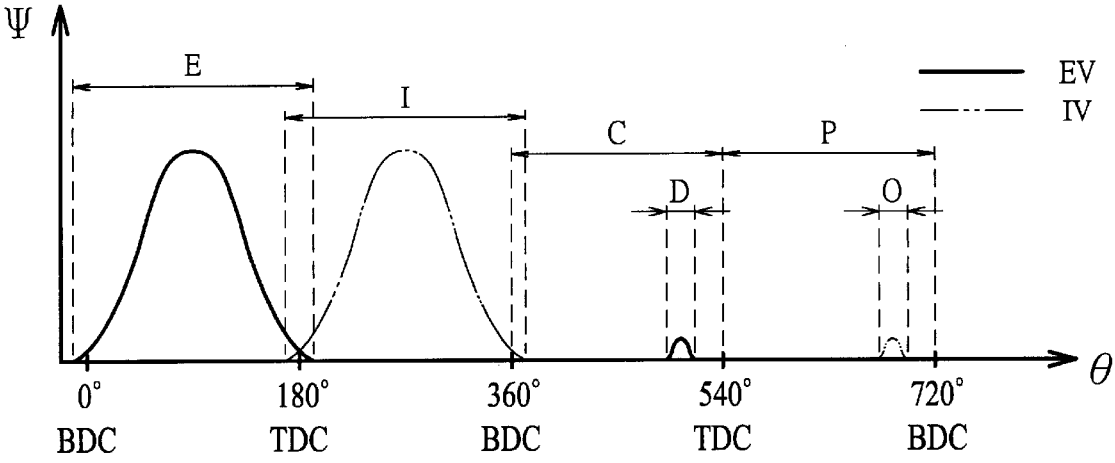
FIG. 4 is a chart showing the relationship between the opening Ψ of the inlet (exhaust) valve and the crank angle θ according to a preferred embodiment of the invention.

FIG. 4 is a chart showing the relationship between the opening Ψ of the inlet (exhaust) valve and the crank angle θ according to a preferred embodiment of the invention. As the main parts in this figure are the same as those in FIG. 3, detail description of the symbols is omitted.

As shown in FIG. 4, the main parts are the same as those in FIG. 3, however, a decompression process D is added before the TDC in the compression stroke C so that the exhaust valve EV is opened temporarily to decompress the pressure in the cylinder and to reduce the starting force. Furthermore, because the inlet valve and the exhaust valve are controlled by the same cam, a process O of opening the inlet valve in the power stroke P is generated, this process, however, does not affect the operation of the engine when starting the engine.

In order to realize the decompression process, the structure according to the preferred embodiment of the invention will be described referring the accompanying drawings.

Figure 5:
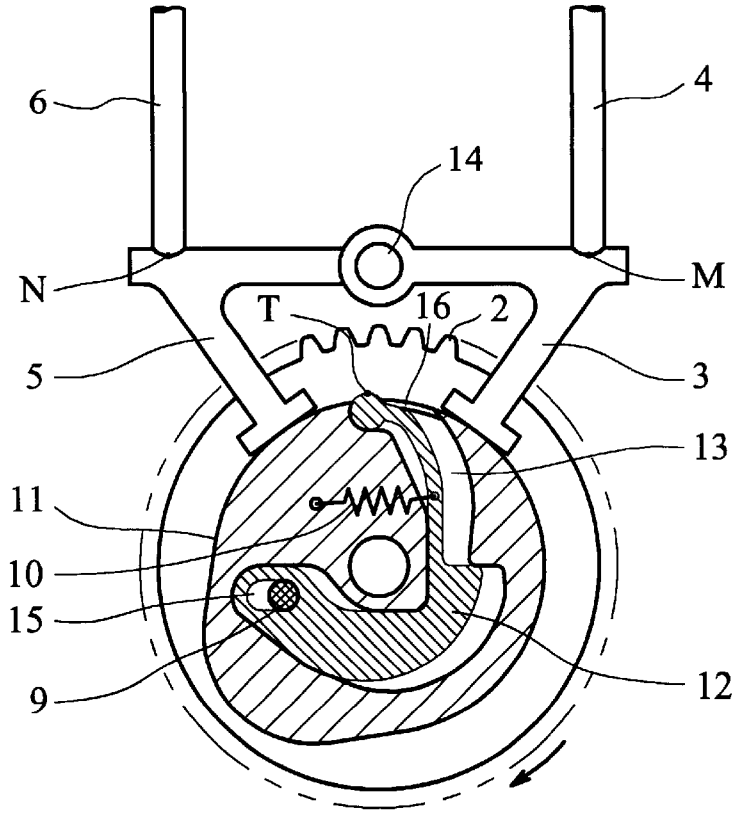
FIG. 5 is a front view showing a cam-follower mechanism according to a preferred embodiment of the invention.
Figure 6A:
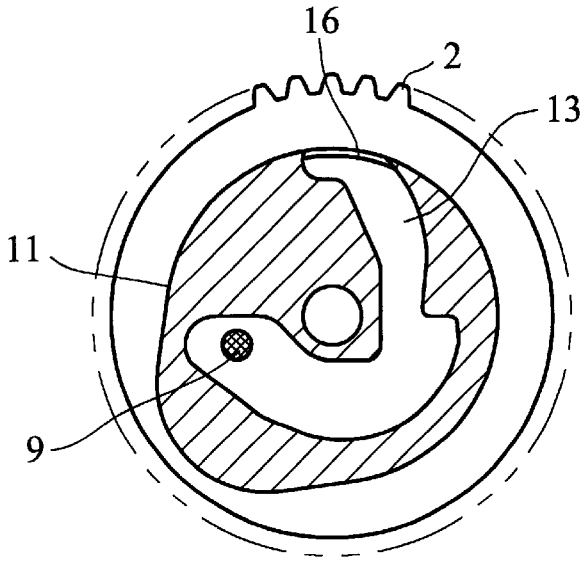
FIG. 6A is a front view showing a cam-gear structure of a decompression device for a four-stroke engine according to the preferred embodiment of the invention.
Figure 6B:
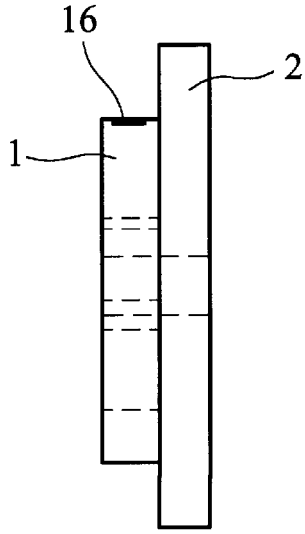
FIG. 6B is a side view of FIG. 6A.

FIG. 5 is a front view showing a cam-follower mechanism according to a preferred embodiment of the invention. FIG. 6A is a front view showing a cam-gear structure of a decompression device for a four-stroke engine according to the preferred embodiment of the invention. FIG. 6B is a side view of FIG. 6A.

Figure 7:
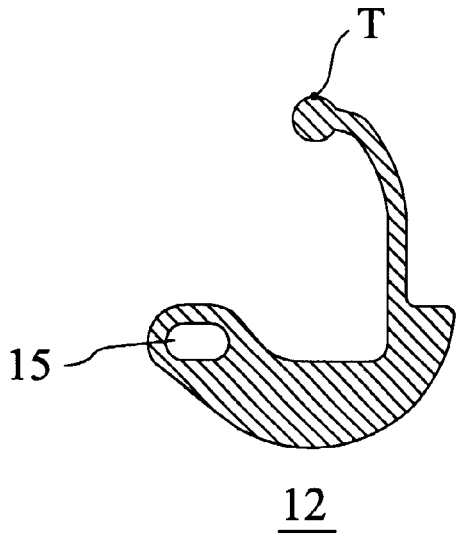
FIG. 7 is a sectional view showing a centrifugal member of a decompression device for a four-stroke engine according the preferred embodiment of the invention.

As shown in FIG. 5, the cam-follower mechanism comprises a cam 1 (see the detail in FIG. 6A) having a guiding recess 13, a center hole 7, a pin 9 and a slot 16, a gear 2 having the same center hole 7 as that of cam 1 and is fixed to cam 1, a centrifugal member 12 (see the detail in FIG. 7) having an elliptic through hole 15 and a projecting portion T, a spring 10 fixed to cam 1 and centrifugal member 12, a first follower 3 and a second follower 5 keeping in contact with cam 1 respectively and swingable around a pin 14, and a first link 4 and a second link 6 keeping in contact with first follower 3 and second follower 5 respectively.

The cam-follower mechanism according to the preferred embodiment is similar to the conventional cam-follower mechanism with some exceptions to be described below.

Figure 8:
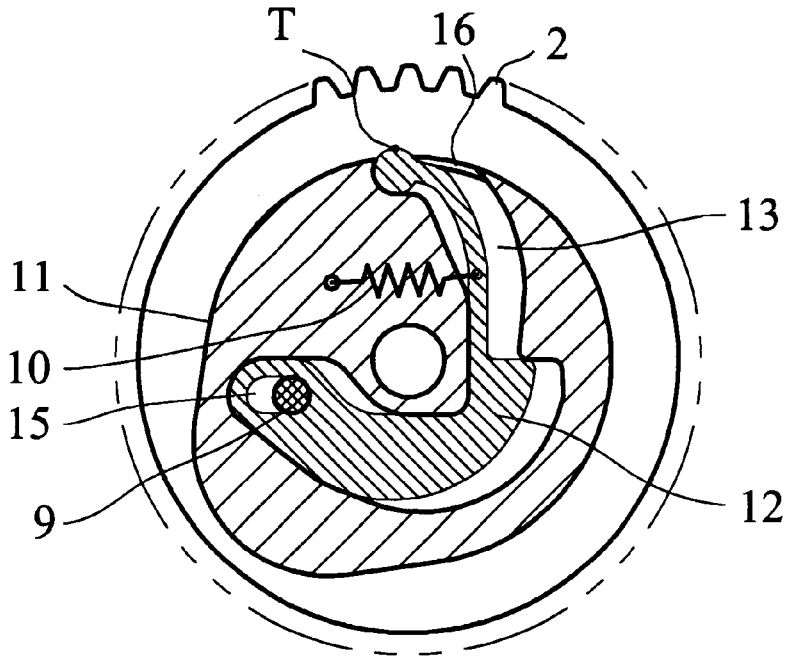
FIG. 8 is a front view showing a decompression device for a four-stroke engine according to the preferred embodiment of the invention when the engine shaft is stationary.

FIG. 8 is a front view showing a decompression device for a four-stroke engine according to the preferred embodiment of the invention when the engine shaft is stationary. Referring to FIG. 8, guiding recess 13 is provided on cam 1. A restoring force is applied to centrifugal member 12 by spring 10 so that the left side of centrifugal member 12 and the left side of guiding recess 13 are kept in contact with each other, and the right side of elliptic through hole 15 is kept in contact with pin 9.

Figure 9:
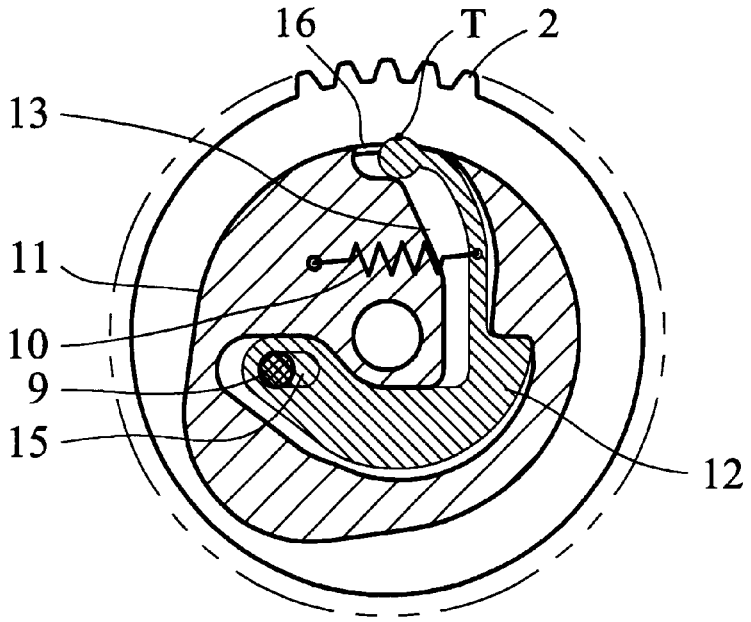
FIG. 9 is a front view showing a decompression device for a four-stroke engine according to the preferred embodiment of the invention when starting the engine.

FIG. 9 is a front view showing a decompression device for a four-stroke engine according to the preferred embodiment of the invention when starting the engine. Referring to FIG. 9 and FIG. 5, because centrifugal member 12 is rotated together with cam 1, a centrifugal force is generated so that centrifugal member 12 is moved toward the right. However, due to the restoring force of spring 15 and the restriction condition between pin 9 and ellipse hole 15, centrifugal member 12 is located at a position where projecting portion T of centrifugal member 12 may project from slot 16 to the outside of the cam profile surface. In this case, projecting portion T may lift second link 6 via second follower 5 so as to temporarily open the exhaust valve (not shown) before the TDC of the compression stroke. Therefore, the pressure in the cylinder is decompressed and the relationship between the opening Ψ of the inlet (exhaust) valve and the crank angle θ is shown in FIG. 4.

Figure 10:
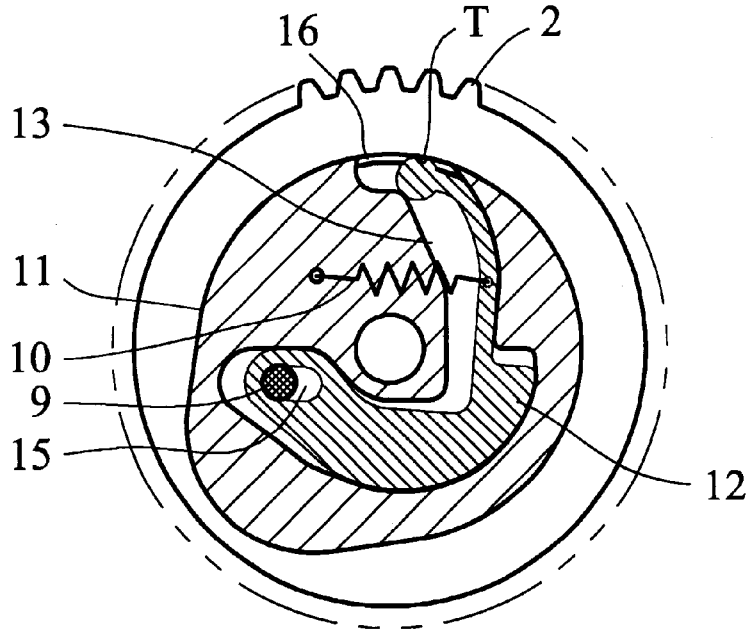
FIG. 10 is a front view showing a decompression device for a four-stroke engine according to the preferred embodiment of the invention when the engine is operated normally.

FIG. 10 is a front view showing a decompression device for a four-stroke engine according to the preferred embodiment of the invention when the engine is operated normally. In this case, the rotating speed of cam 1 is higher than that when starting the engine. Referring to FIG. 10, the centrifugal force is strong enough to cause centrifugal member 12 to rotate clockwise so that the bottom right side thereof is kept in contact with guiding recess 13. As a result, projecting portion T of centrifugal member 12 sinks into the inside of the cam profile surface so that the decompression function is disabled and the engine may operate normally and the relationship between the opening of the inlet (exhaust) valve and the crank angle is shown in FIG. 3.

Therefore, a decompression function is enabled when starting the engine so as to reduce the starting force, and is disabled when the engine is operated normally.

While the preferred embodiment and the example of the present invention have been described using specific terms, such description is for illustrative purpose only, and it is to be understood that changes and modifications may be made without departing from the spirit or scope of the following claims. For example, although a decompression function is illustrated to be enabled by using a guiding recess, a pin, an elliptic through hole, a spring and a centrifugal member, it should be understood that the same function may also be realized by other proper variations in the construction of the centrifugal member, the guiding recess and the spring.

What is claimed is:

1. A decompression device for a four-stroke engine, wherein the operating cycle of the engine includes an inlet stroke, a compression stroke, a power stroke and an exhaust stroke, and the engine includes a piston which reaches a top dead center (TDC) and a bottom dead center (BDC) at the two ends of each stroke, said decompression device comprising:

an inlet valve and an exhaust valve for controlling the inlet stroke and the exhaust stroke respectively, a first rocker and a second rocker for driving the inlet valve and the exhaust valve respectively, a first link and a second link for driving the first and the second rocker respectively, a first follower and a second follower for driving the first link and the second link respectively, and a cam having a cam profile surface for driving the first and the second followers, characterized in:

that said cam further comprises a guiding recess provided on the side surface thereof and a slot provided on the cam profile surface communicating with said guiding recess;

that said decompression device further comprises a centrifugal member, received within said guiding recess, having a projecting portion and being rotatable and movable within said guiding recess, and a spring having two ends fixed to said cam and said centrifugal member; and that through the cooperation with said spring and said guiding recess, when said cam is rotated at a lower speed, said projecting portion of said centrifugal member projects through said slot to the outside of the cam profile surface under the action of a weaker centrifugal force, thereby lifting the second follower so as to open the exhaust valve before the TDC of the compression stroke, and when said cam is rotated at a higher speed, said projecting portion of said centrifugal member sinks into the inside of the cam profile surface under the action of a stronger centrifugal force, thereby closing the exhaust valve.

2. A decompression device for a four-stroke engine according to claim 1, wherein said centrifugal member further comprises an elliptic through hole, and said cam further comprises at least one pin located in said guiding recess and penetrating through said elliptic through hole, thereby guiding the movement and rotation of said centrifugal member.

* * * * *